US006382241B1

(12) United States Patent
Setrum

(10) Patent No.: US 6,382,241 B1
(45) Date of Patent: May 7, 2002

(54) VACUUM HOSE ASSEMBLY FOR A PERMANENTLY INSTALLED BUILDING VACUUM CLEANER SYSTEM

(76) Inventor: Arthur Setrum, Box 239, Coronach, Saskatchewan, Sohozo (CA)

( * ) Notice: Subject to any disclaimer, the term of this patent is extended or adjusted under 35 U.S.C. 154(b) by 0 days.

(21) Appl. No.: 09/827,602

(22) Filed: Apr. 5, 2001

(51) Int. Cl.[7] ..... B65H 75/34

(52) U.S. Cl. ..... 137/355.22; 137/355.26; 137/360; 242/390.8; 242/397.3

(58) Field of Search ..... 137/355.22, 355.26, 137/360, 355.23, 397.3; 242/390.8

(56) References Cited

U.S. PATENT DOCUMENTS

| | | | | |
|---|---|---|---|---|
| 44,268 A | | 9/1864 | Ament | |
| 645,798 A | | 3/1900 | Foster | |
| 1,043,647 A | | 11/1912 | Wagner | |
| 1,143,125 A | | 6/1915 | Lawhead | |
| 2,243,624 A | | 5/1941 | Gazet | 242/157 |
| 2,249,117 A | | 7/1941 | Crandall | 254/190 |
| 2,301,208 A | | 11/1942 | Gear | 242/86 |
| 2,595,655 A | | 5/1952 | Hannay | 242/86 |
| 2,599,423 A | | 6/1952 | Ziegler | 242/86 |
| 3,401,420 A | | 9/1968 | Lofgren | 15/323 |
| 3,464,859 A | * | 9/1969 | Hamrick | 134/21 |
| 3,670,977 A | | 6/1972 | Boneck | 242/54 R |
| 3,670,988 A | | 6/1972 | Leonard | 242/158 R |
| 3,671,016 A | | 6/1972 | Gladysz | 254/190 |
| 3,833,184 A | | 9/1974 | Hara et al. | 242/158 |
| 3,836,123 A | | 9/1974 | Bausenbach et al. | 254/186 |
| 3,911,944 A | * | 10/1975 | Hukuba et al. | 137/355.2 |
| 3,939,862 A | | 2/1976 | Booth | 137/355.16 |
| 4,150,801 A | | 4/1979 | Ikegami et al. | 242/158 |
| 4,174,809 A | | 11/1979 | Arlemack | 239/189 |
| 4,421,284 A | | 12/1983 | Pan | 242/158 |
| 4,903,911 A | | 2/1990 | Sepke | 242/86 |
| 5,119,843 A | | 6/1992 | Kennan | 137/355.23 |
| 5,364,043 A | | 11/1994 | Linderoth | 242/397 |
| 5,402,551 A | | 4/1995 | Workhaven et al. | 15/315 |
| D365,012 S | | 12/1995 | Sather | D8/359 |
| 5,947,406 A | | 9/1999 | Burlingame | 242/478.2 |

* cited by examiner

*Primary Examiner*—A. Michael Chambers
(74) *Attorney, Agent, or Firm*—Joseph N. Breaux

(57) ABSTRACT

A vacuum hose assembly for built-in or permanently installed vacuum cleaner systems that includes a motor powered reel assembly for allowing a user to extend and/or retract the flexible vacuum hose as needed and preventing the vacuum hose from becoming entangled while stored between uses. The vacuum hose assembly includes a reel support bracket assembly, a flexible vacuum hose, a motor driven vacuum hose drum reel assembly, a vacuum hose alignment assembly and a drum reel drive motor assembly.

1 Claim, 5 Drawing Sheets

VACUUM HOSE ASSEMBLY FOR A PERMANENTLY INSTALLED BUILDING VACUUM CLEANER SYSTEM

TECHNICAL FIELD

The present invention relates to permanently installed, building vacuum cleaner systems for buildings wherein the building vacuum cleaner system includes a central vacuum motor assembly installed within the building and in connection with a vacuum generating canister assembly having a debris collecting cannister and a number of vacuum inlet pipes each having a cannister connecting pipe end in connection with the debris collecting cannister, a middle pipe portion routed through the building to a desired vacuum hose connecting location for each vacuum inlet pipe, and a vacuum hose connecting pipe end adapted for connection with a vacuum hose assembly including a flexible vacuum hose and more particularly to a vacuum hose assembly for a permanently installed, building vacuum cleaner system that includes a reel support bracket assembly, a flexible vacuum hose, a motor driven vacuum hose drum reel assembly, a vacuum hose alignment assembly and a drum reel drive motor assembly; the reel support bracket assembly having a pair of spaced drum reel supports each rotatably connected to a separate spaced, parallel oriented drum end plate of a motor driven vacuum hose drum reel such that the motor driven vacuum hose drum reel of the motor driven vacuum hose drum reel assembly rotates about a drum reel axis of rotation oriented through the centers of the two spaced, parallel oriented drum end plates; the motor driven vacuum hose drum reel further including a sealed hollow interior debris capture chamber defined between the two spaced, parallel oriented drum end plates and a drum reel tube portion in sealed connected between the spaced, parallel oriented drum end plates; the sealed hollow interior debris capture chamber being accessible through a rotatable inlet pipe connecting fitting, rotatably connected to a center of one of the two spaced, parallel oriented drum end plates and an L-shaped vacuum hose connecting fitting having one end connected through the drum reel tube portion and a second end adapted for detachable connection with a reel drum connecting end of the flexible vacuum hose; the drum reel drive motor assembly including a bi-directional drive motor in mechanical driving connection with the motor driven vacuum hose drum reel and in controlled connection with a three-position direction control switch, a hose-fully-extended limit switch, and a hose-fully-retracted limit switch; the three-position direction control switch including an "off" position, a "hose retract" position, and a "hose extend" position; the hose-fully-extended limit switch stopping operation of the drive motor in the extend direction when activated; the hose-fully-retracted limit switch stopping operation of the drive motor in the retract direction when activated; the vacuum hose alignment assembly being carried on a biased, slide tube slidably mounted onto a cross bar of the reel support bracket assembly and including a pair of spaced, rotatable, hose positioning spools between which a section of the flexible vacuum hose is positioned and a spool positioning assembly including a hose contact roller extending from the slide tube and directed toward a section of the flexible vacuum hose wound onto the drum reel tube portion of the motor driven vacuum hose drum reel between the two spaced, parallel oriented drum end plates such that a force is generated between the section of the flexible vacuum hose wound onto the drum reel tube portion of the motor driven vacuum hose drum reel and the hose contact roller sufficient to overcome the biasing force when the motor is operating in the retract direction to move the pair of spaced, rotatable, hose positioning spools along the cross bar in a manner to uniformly coil the flexible vacuum hose around the drum reel tube portion of the motor driven vacuum hose drum reel. is positioned and a spool.

BACKGROUND ART

Central or built-in vacuum cleaner systems are often installed in homes and other buildings so that the need for moving a heavy vacuum cleaner around the building to vacuum each room is eliminated. Although such vacuum cleaner systems eliminate the need for transporting the heavy vacuum cleaner motor and dirt collecting container, they require long vacuum hoses which, in use, are coupled to one of a number of vacuum inlet pipes that are installed throughout the building. Because the floor areas of entire building must be reached by the vacuum hose, the vacuum hoses are typically long and are easily tangled which makes use of the vacuum system difficult. It would be a benefit, therefore, to have a vacuum hose assembly for a built-in or permanently installed vacuum cleaner system that included a motor powered reel assembly for allowing a user to extend and/or retract the flexible vacuum hose as needed and preventing the vacuum hose from becoming entangled while stored between uses.

GENERAL SUMMARY DISCUSSION OF INVENTION

It is thus an object of the invention to provide a vacuum hose assembly for a permanently installed, building vacuum cleaner system that includes a reel support bracket assembly, a flexible vacuum hose, a motor driven vacuum hose drum reel assembly, a vacuum hose alignment assembly and a drum reel drive motor assembly; the reel support bracket assembly having a pair of spaced drum reel supports each rotatably connected to a separate spaced, parallel oriented drum end plate of a motor driven vacuum hose drum reel such that the motor driven vacuum hose drum reel of the motor driven vacuum hose drum reel assembly rotates about a drum reel axis of rotation oriented through the centers of the two spaced, parallel oriented drum end plates; the motor driven vacuum hose drum reel further including a sealed hollow interior debris capture chamber defined between the two spaced, parallel oriented drum end plates and a drum reel tube portion in sealed connected between the spaced, parallel oriented drum end plates; the sealed hollow interior debris capture chamber being accessible through a rotatable inlet pipe connecting fitting, rotatably connected to a center of one of the two spaced, parallel oriented drum end plates and an L-shaped vacuum hose connecting fitting having one end connected through the drum reel tube portion and a second end adapted for detachable connection with a reel drum connecting end of the flexible vacuum hose; the drum reel drive motor assembly including a bi-directional drive motor in mechanical driving connection with the motor driven vacuum hose drum reel and in controlled connection with a three-position direction control switch, a hose-fully-extended limit switch, and a hose-fully-retracted limit switch; the three-position direction control switch including an "off" position, a "retract" position, and a "hose extend" position; the hose-fully-extended limit switch stopping operation of the drive motor in the extend direction when activated; the hose-fully-retracted limit switch stopping operation of the drive motor in the retract direction when activated; the vacuum hose alignment assembly being carried on a biased, slide tube slidably mounted onto a cross bar of the reel support bracket assembly and including a pair of spaced, rotatable, hose positioning spools between which a section of the flexible vacuum hose is positioned and a spool positioning assembly including a hose contact roller extending from the slide tube and directed toward a section of the flexible vacuum hose wound onto the drum reel tube portion of the motor driven vacuum hose drum reel between the two spaced, parallel oriented drum end plates such that a force is generated between the section of the flexible vacuum hose wound onto the drum reel tube portion of the motor driven vacuum hose drum reel and the hose contact roller sufficient to overcome the biasing force when the motor is operating in the retract direction to move the pair of spaced, rotatable, hose positioning spools along the cross bar in a manner to uniformly coil the flexible vacuum hose around the drum reel tube portion of the motor driven vacuum hose drum reel.

Accordingly, a vacuum hose assembly for a permanently installed, building vacuum cleaner system is provided. The vacuum hose assembly for a permanently installed, building vacuum cleaner system includes a reel support bracket assembly, a flexible vacuum hose, a motor driven vacuum hose drum reel assembly, a vacuum hose alignment assembly and a drum reel drive motor assembly; the reel support bracket assembly having a pair of spaced drum reel supports each rotatably connected to a separate spaced, parallel oriented drum end plate of a motor driven vacuum hose drum reel such that the motor driven vacuum hose drum reel of the motor driven vacuum hose drum reel assembly rotates about a drum reel axis of rotation oriented through the centers of the two spaced, parallel oriented drum end plates; the motor driven vacuum hose drum reel further including a sealed hollow interior debris capture chamber defined between the two spaced, parallel oriented drum end plates and a drum reel tube portion in sealed connected between the spaced, parallel oriented drum end plates; the sealed hollow interior debris capture chamber being accessible through a rotatable inlet pipe connecting fitting, rotatably connected to a center of one of the two spaced, parallel oriented drum end plates and an L-shaped vacuum hose connecting fitting having one end connected through the drum reel tube portion and a second end adapted for detachable connection with a reel drum connecting end of the flexible vacuum hose; the drum reel drive motor assembly including a bi-directional drive motor in mechanical driving connection with the motor driven vacuum hose drum reel and in controlled connection with a three-position direction control switch, a hose-fully-extended limit switch, and a hose-fully-retracted limit switch; the three-position direction control switch including an "off" position, a "hose retract" position, and a "hose extend" position; the hose-fully-extended limit switch stopping operation of the drive motor in the extend direction when activated; the hose-fully-retracted limit switch stopping operation of the drive motor in the retract direction when activated; the vacuum hose alignment assembly being carried on a biased, slide tube slidably mounted onto a cross bar of the reel support bracket assembly and including a pair of spaced, rotatable, hose positioning spools between which a section of the flexible vacuum hose is positioned and a spool positioning assembly including a hose contact roller extending from the slide tube and directed toward a section of the flexible vacuum hose wound onto the drum reel tube portion of the motor driven vacuum hose drum reel between the two spaced, parallel oriented drum end plates such that a force is generated between the section of the flexible vacuum hose wound onto the drum reel tube portion of the motor driven vacuum hose drum reel and the hose contact roller sufficient to overcome the biasing force when the motor is operating in the retract direction to move the pair of spaced, rotatable, hose positioning spools along the cross bar in a manner to uniformly coil the flexible vacuum hose around the drum reel tube portion of the motor driven vacuum hose drum reel.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
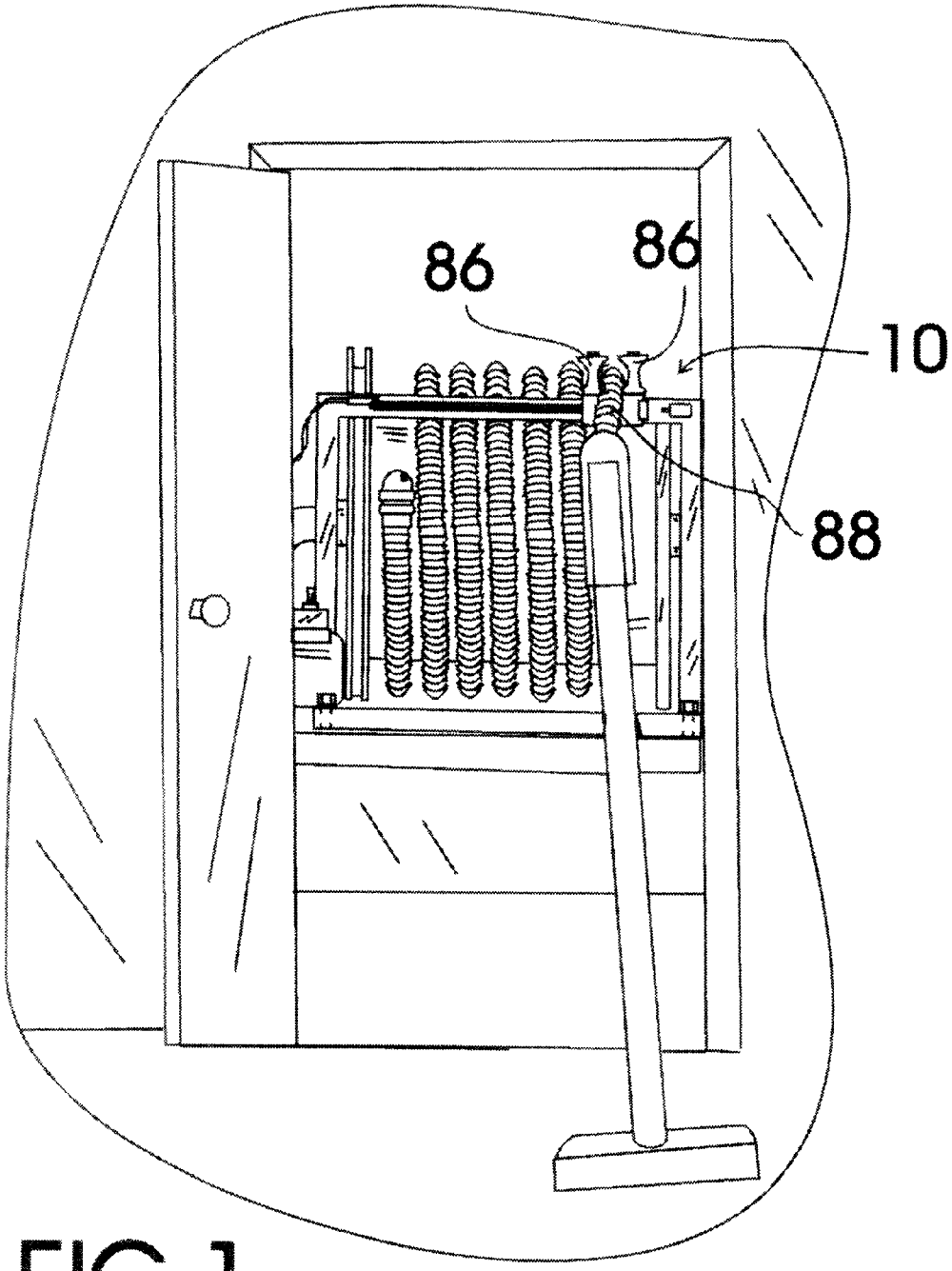
FIG. 1 is a front plan view of an exemplary embodiment of the vacuum hose assembly for a permanently installed, building vacuum cleaner system of the present invention installed within a closet of a building.

FIG. 1 shows various aspects of an exemplary embodiment of the vacuum hose assembly for a permanently installed, building vacuum cleaner system of the present invention generally designated 10. Vacuum hose assembly 10 includes a reel support bracket assembly, generally designated 12; a flexible vacuum hose, generally designated 14; a motor driven vacuum hose drum reel assembly, generally designated 16; a vacuum hose alignment assembly, generally designated 18; and a drum reel drive motor assembly, generally designated 20.

Figure 2:
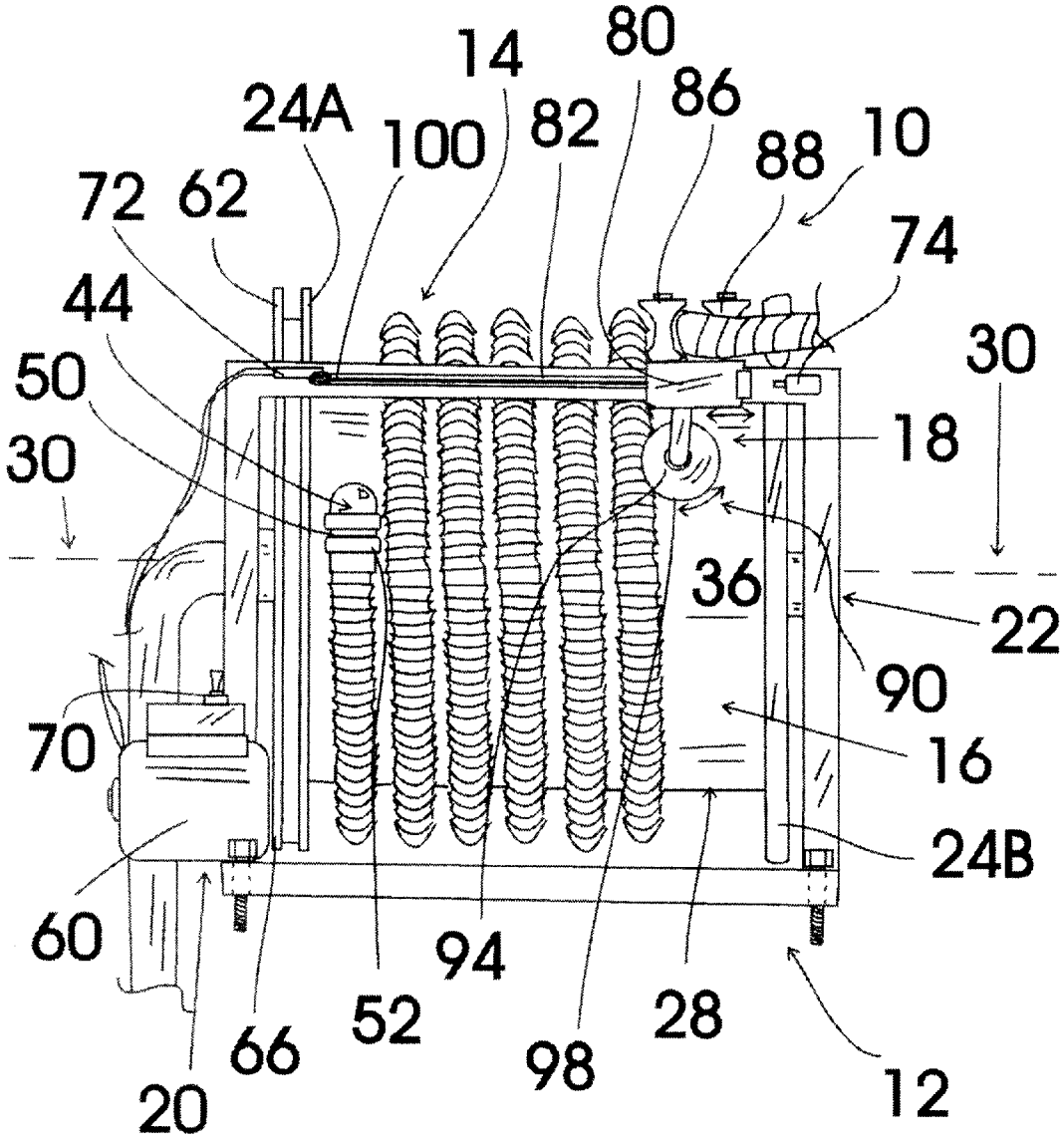
FIG. 2 is a front plan view of an exemplary embodiment of the vacuum hose assembly for a permanently installed, building vacuum cleaner system of FIG. 1 in isolation with the vacuum cleaner suction head detached from the flexible vacuum hose.
Figure 3:
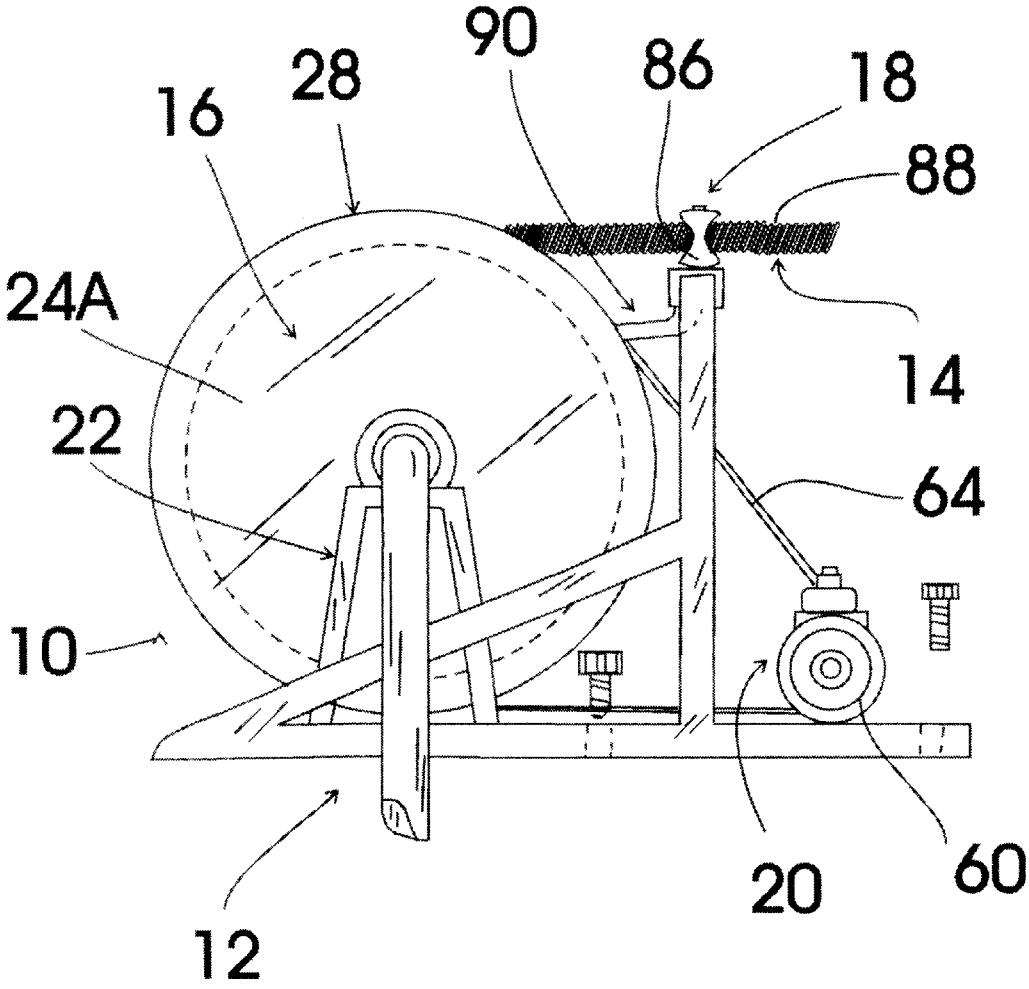
FIG. 3 is a side plan view of the vacuum hose assembly of FIG. 2.
Figure 4:
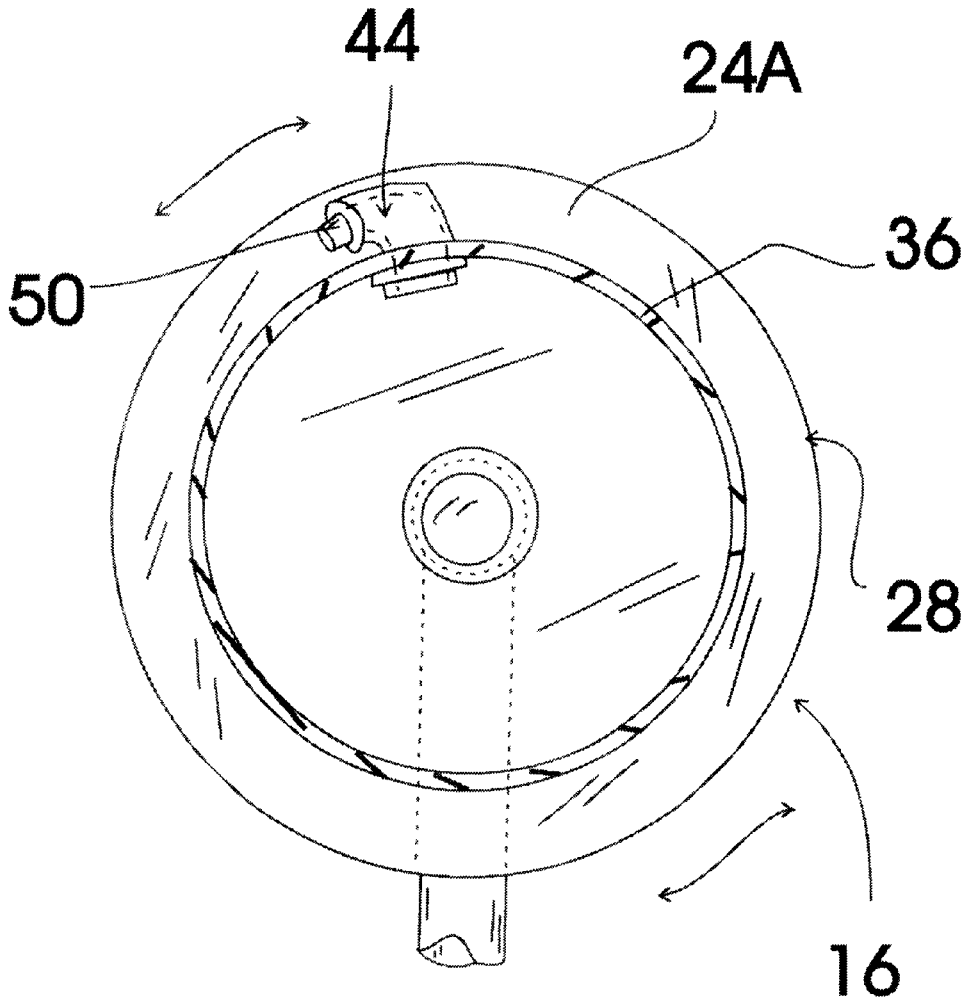
FIG. 4 is sectional view through the drum reel showing a portion of the sealed hollow interior debris capture chamber of the motor driven vacuum hose drum reel, the rotatable inlet pipe connecting fitting, rotatably connected to the center of one of the two spaced, parallel oriented drum end plates, and the L-shaped vacuum hose connecting fitting having one end connected through the drum reel tube portion and a second end adapted for detachable connection with a reel drum connecting end of the flexible vacuum hose.
Figure 5:
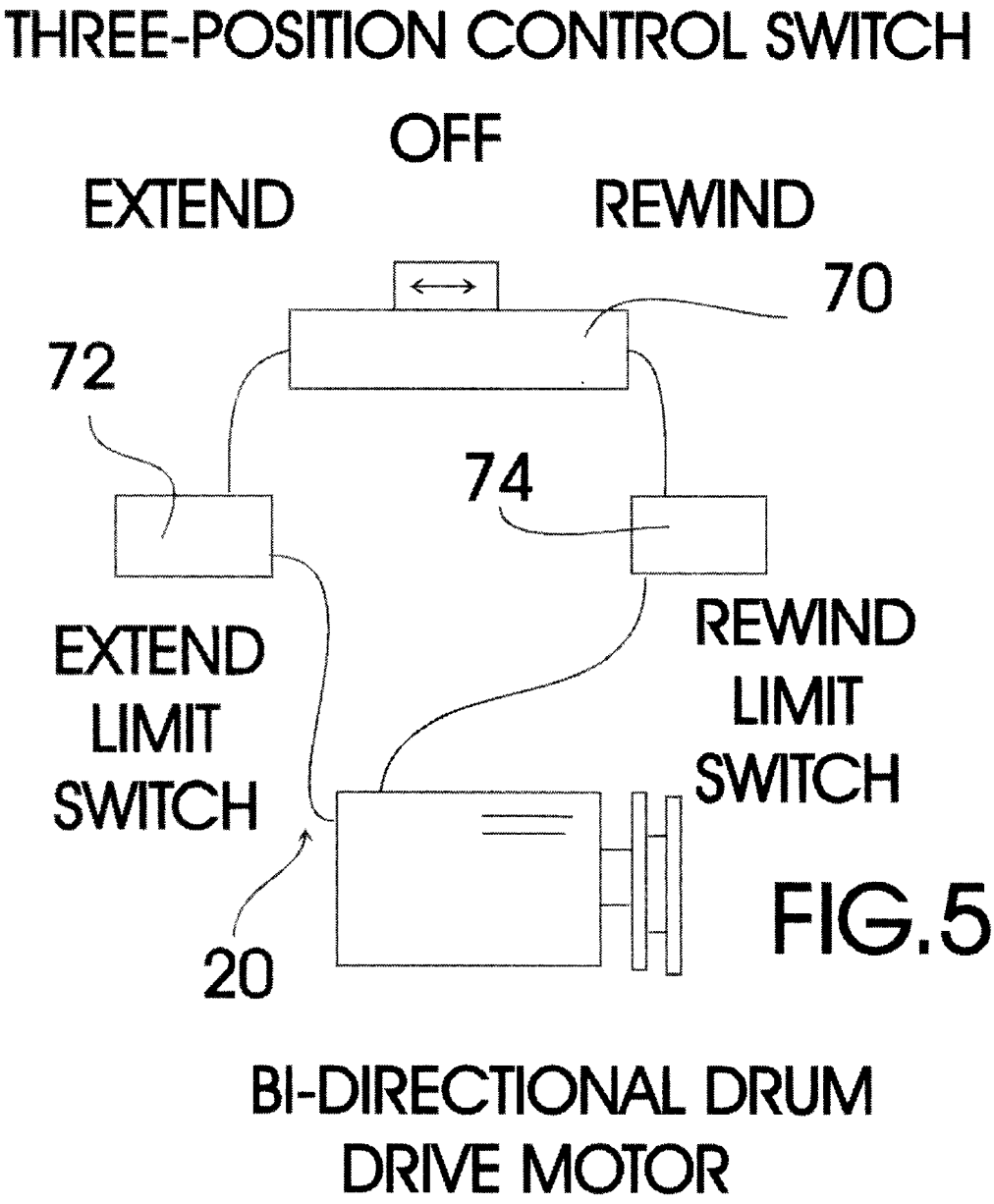
FIG. 5 is a schematic diagram showing the bi-directional drum drive motor, the extend limit switch, the rewind limit switch, and the three-position control switch.

Reel support bracket assembly 12 has a pair of spaced drum reel supports, each generally designated 22, that are each rotatably connected to a separate spaced, parallel oriented drum end plate 24*a*,24*b* of a motor driven vacuum hose drum reel, generally designated 28 such that motor driven vacuum hose drum reel 28 of motor driven vacuum hose drum reel assembly 16 rotates about a drum reel axis of rotation 30 (shown in dashed lines FIG. 2) oriented through the centers of the two spaced, parallel oriented drum end plates 24*a*,24*b*. Motor driven vacuum hose drum reel 28 also includes a sealed hollow interior debris capture chamber 30 that is defined between the two spaced, parallel oriented drum end plates 24*a*,24*b* and a drum reel tube portion 36 in sealed connected between the spaced, parallel oriented drum end plates 24*a*,24*b*. Sealed hollow interior debris capture chamber 30 is accessible through a rotatable inlet pipe connecting fitting, generally designated 40 that is rotatably connected to a center of drum end plate 24*a* and an L-shaped vacuum hose connecting fitting, generally designated 44, having one end 46 connected through the drum reel tube portion 36 and a second end 50 adapted for detachable connection with a reel drum connecting end 52 of flexible vacuum hose 14.

Drum reel drive motor assembly 20 includes a bi-directional drive motor 60 in mechanical driving connection with a pulley wheel portion 62 of motor driven vacuum hose drum reel 28 by drive belt 64 and motor pulley 66. Drive motor 60 is in controlled connection with a three-position direction control switch 70; a hose-fully-extended limit switch 72, and a hose-fully-retracted limit switch 74. Three-position direction control switch 70 includes an "off" position, a "hose retract" position, and a "hose extend" position. Hose-fully-extended limit switch 72 stops operation of drive motor 60 in the extend direction when it is activated by contact by the vacuum hose alignment assembly 18. Hose-fully-retracted limit switch 74 stops operation of drive motor 60 in the retract direction when it is activated by contact by the vacuum hose alignment assembly 18.

Vacuum hose alignment assembly 18 is slidably carried on a biased, slide tube 80 that is slidably mounted onto a cross bar 82 of reel support bracket assembly 12 and includes a pair of spaced, rotatable, hose positioning spools 86 between which a section 88 of flexible vacuum hose 14 is positioned and a spool positioning assembly, generally designated 90 that includes a hose contact roller 94 that extends from slide tube 80 and is directed toward a section 98 of flexible vacuum hose 14 wound onto drum reel tube portion 36 of motor driven vacuum hose drum reel 28 between the two spaced, parallel oriented drum end plates 24*a*,24*b* such that a force is generated between the section 98 of flexible vacuum hose 14 wound onto drum reel tube portion 36 of motor driven vacuum hose drum reel 28 and hose contact roller 94 that is sufficient to overcome the biasing force of elastic biasing member 100 when the motor 60 is operating in the retract direction to move the pair of spaced, rotatable, hose positioning spools 86 along cross bar 82 in a manner to uniformly coil flexible vacuum hose 14 around drum reel tube portion 36 of motor driven vacuum hose drum reel 28.

It can be seen from the preceding description that a vacuum hose assembly for a permanently installed, building vacuum cleaner system has been provided.

It is noted that the embodiment of the vacuum hose assembly for a permanently installed, building vacuum cleaner system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A vacuum hose assembly for a permanently installed, building vacuum cleaner system that include a central vacuum motor assembly installed within a building and in connection with a vacuum generating canister assembly having a debris collecting cannister and a number of vacuum inlet pipes each having a cannister connecting pipe end in connection with the debris collecting cannister, a middle pipe portion routed through the building to a desired vacuum hose connecting location for each vacuum inlet pipe, and a vacuum hose connecting pipe end adapted for connection with a vacuum hose assembly including a flexible vacuum hose; the vacuum hose assembly for a permanently installed, building vacuum cleaner system comprising:

a reel support bracket assembly;

a flexible vacuum hose;

a motor driven vacuum hose drum reel assembly;

a vacuum hose alignment assembly; and a drum reel drive motor assembly; the reel support bracket assembly having a pair of spaced drum reel supports each rotatably connected to a separate spaced, parallel oriented drum end plate of a motor driven vacuum hose drum reel such that the motor driven vacuum hose drum reel of the motor driven vacuum hose drum reel assembly rotates about a drum reel axis of rotation oriented through the centers of the two spaced, parallel oriented drum end plates;

the motor driven vacuum hose drum reel further including a sealed hollow interior debris capture chamber defined between the two spaced, parallel oriented drum end plates and a drum reel tube portion in sealed connected between the spaced, parallel oriented drum end plates;

the sealed hollow interior debris capture chamber being accessible through a rotatable inlet pipe connecting fitting, rotatably connected to a center of one of the two spaced, parallel oriented drum end plates and an L-shaped vacuum hose connecting fitting having one end connected through the drum reel tube portion and a second end adapted for detachable connection with a reel drum connecting end of the flexible vacuum hose;

the drum reel drive motor assembly including a bi-directional drive motor in mechanical driving connection with the motor driven vacuum hose drum reel and in controlled connection with a three-position direction control switch, a hose-fully-extended limit switch, and a hose-fully-retracted limit switch;

the three-position direction control switch including an "off" position, a "hose retract" position, and a "hose extend" position;

the hose-fully-extended limit switch stopping operation of the drive motor in the extend direction when activated;

the hose-fully-retracted limit switch stopping operation of the drive motor in the retract direction when activated;

the vacuum hose alignment assembly being carried on a biased, slide tube slidably mounted onto a cross bar of the reel support bracket assembly and including a pair of spaced, rotatable, hose positioning spools between which a section of the flexible vacuum hose is positioned and a spool positioning assembly including a hose contact roller extending from the slide tube and directed toward a section of the flexible vacuum hose wound onto the drum reel tube portion of the motor driven vacuum hose drum reel between the two spaced, parallel oriented drum end plates such that a force is generated between the section of the flexible vacuum hose wound onto the drum reel tube portion of the motor driven vacuum hose drum reel and the hose contact roller sufficient to overcome the biasing force when the motor is operating in the retract direction to move the pair of spaced, rotatable, hose positioning spools along the cross bar in a manner to uniformly coil the flexible vacuum hose around the drum reel tube portion of the motor driven vacuum hose drum reel.

* * * * *